US006139131A

United States Patent [19]

Prasad et al.

[11] Patent Number: 6,139,131

[45] Date of Patent: Oct. 31, 2000

[54] HIGH DROP GENERATOR DENSITY PRINTHEAD

[75] Inventors: Rama Prasad, Albany; Todd A. Cleland; Robert C. Maze, both of Corvallis; Dale R. Oughton, Albany, all of Oreg.

[73] Assignee: Hewlett-Packard Company, Palo Alto, Calif.

[21] Appl. No.: 09/386,028

[22] Filed: Aug. 30, 1999

[51] Int. Cl.[7] ..... B41J 2/05

[52] U.S. Cl. ..... 347/63; 347/64

[58] Field of Search ..... 347/63, 64, 65, 347/57, 58, 40, 42, 12, 9, 13, 48

[56] References Cited

U.S. PATENT DOCUMENTS

| | | | |
|---|---|---|---|
| 3,852,563 | 12/1974 | Bohorquez et al. | 219/216 |
| 4,458,256 | 7/1984 | Shirato et al. | 347/57 |
| 4,809,428 | 3/1989 | Aden et al. | 347/63 |
| 4,812,859 | 3/1989 | Chan et al. | 346/140 R |
| 5,006,864 | 4/1991 | Ayata et al. | 346/33 R |
| 5,187,500 | 2/1993 | Bohorquez et al. | 347/63 |
| 5,508,724 | 4/1996 | Boyd et al. | 347/58 |
| 5,563,635 | 10/1996 | Kneezel et al. | 347/12 |
| 5,600,349 | 2/1997 | Keefe | 347/11 |
| 5,604,519 | 2/1997 | Keefe et al. | 347/13 |
| 5,635,968 | 6/1997 | Bhaskar et al. | 347/59 |
| 5,638,101 | 6/1997 | Keefe et al. | 347/65 |
| 5,640,183 | 6/1997 | Hackleman | 347/40 |
| 5,883,650 | 3/1999 | Figueredo et al. | 347/62 |

FOREIGN PATENT DOCUMENTS

| | | | |
|---|---|---|---|
| 0124312A2 | 11/1984 | European Pat. Off. | B41J 3/04 |

*Primary Examiner*—John Barlow
*Assistant Examiner*—Juanita Stephens
*Attorney, Agent, or Firm*—Raymond A. Jenski

[57] ABSTRACT

A thermal inkjet printing apparatus employs a segmented heater resistor, a thin passivation layer, and a lower heater resistor activation energy to realize a high density drop generator printhead.

16 Claims, 10 Drawing Sheets

HIGH DROP GENERATOR DENSITY PRINTHEAD

BACKGROUND OF THE INVENTION

The present invention relates generally to inkjet printing devices, and more particularly to an inkjet printhead for thermal inkjet printing devices that provides a high density of ink drop generators for ejecting ink from the printhead.

The art of inkjet printing technology is relatively well developed. Conmmercial products such as computer printers, graphics plotters, copiers, and facsimile machines successfully employ inkjet technology for producing hard copy printed output. The basics of the technology has been disclosed, for example, in various articles in the Hewlett-Packard Journal, Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No.1 (February 1994) editions. Inkjet devices have also been described by W. J. Lloyd and H. T. Taub in Output Hardcopy Devices (R. C. Durbeck and S. Sherr, ed., Academic Press, San Diego, 1988, chapter 13).

A thermal inkjet printer for inkjet printing typically includes one or more translationally reciprocating print cartridges in which small drops of ink are ejected by a drop generator towards a medium upon which it is desired to place alphanumeric characters, graphics, or images. Such cartridges typically include a printhead having an orifice member or plate that has a plurality of small nozzles through which the ink drops are ejected. Beneath the nozzles are ink firing chambers, enclosures in which ink resides prior to ejection by an ink ejector through a nozzle. Ink is supplied to the ink firing chambers through ink channels that are in fluid communication with an ink reservoir, which may be contained in a reservoir portion of the print cartridge or in a separate ink container spaced apart from the printhead.

Ejection of an ink drop through a nozzle employed in a thermal inkjet printer is accomplished by quickly heating the volume of ink residing within the ink firing chamber with a selectively energizing electrical pulse to a heater resistor ink ejector positioned in the ink firing chamber. At the commencement of the heat energy output from the heater resistor, an ink vapor bubble nucleates at sites on the surface of the heater resistor or its protective layers. The rapid expansion of the ink vapor bubble forces the liquid ink through the nozzle. Once the electrical pulse ends and an ink drop is ejected, the ink firing chamber refills with ink from the ink channel and ink reservoir.

The minimum electrical energy required to eject an ink drop of a reliable volume is referred to as "turn-on energy". The turn-on energy is a sufficient amount of energy to overcome thermal and mechanical inefficiencies of the ejection process and to form a vapor bubble having sufficient size to eject an amount of ink (generally determined by the design parameters of the firing chamber) from the printhead nozzle. Conventional thermal inkjet printheads operate at a firing energy slightly greater than the turn-on energy to assure that drops of an uniform size are ejected. Adding substantially more energy than the turn-on energy generally does not increase drop size but does deposit excess heat in the printhead.

Following removal of electrical power from the heater resistor, the vapor bubble collapses in the firing chamber in a small but violent way. Components within the printhead in the vicinity of the vapor bubble collapse are susceptible to fluid mechanical stresses (cavitation) as the vapor bubble collapses, thereby allowing ink to crash into the ink firing chamber components. The heater resistor is particularly susceptible to damage from cavitation. One or more protective layers are typically disposed over the resistor and adjacent structures to protect the resistor from cavitation and from chemical attack by the ink. One protective layer in contact with the ink is a mechanically hard cavitation layer that provides protection from the cavitation wear of the collapsing ink. Another layer, a passivation layer, is typically placed between the cavitation layer and the heater resistor and its associated structures to provide protection from chemical attack. Thermal inkjet ink is chemically reactive, and prolonged exposure of the heater resistor and its electrical interconnections to the ink will result in a degradation and failure of the heater resistor and electrical conductors. The foregoing protection layers, however, tend to increase the inherent turn-on energy of the heater resistor required for ejecting ink drops due to the insulating properties of the layers.

Some of the energy that is deposited by the heater resistors is not removed by the ejected ink drop as momentum or increased drop temperature, but remains as heat in the printhead or the remaining ink. As the temperature increases, the ink drop size can change and at some temperature, the printhead will no longer eject ink. Therefore it is important to control the amount of heat that is generated and that remains in the printhead during a printing operation. As more resistors are activated with higher frequencies of activation and are packed with greater density in the printhead, significantly more heat is retained by the printhead. Consequently, there must be a reduction in the amount of energy input to the printhead for higher frequencies and greater drop generator densities to be realized.

The heater resistors of a conventional inkjet printhead comprise a thin film resistive material disposed on an oxide layer of a semiconductor substrate. Electrical conductors are patterned onto the oxide layer and provide an electrical path to and from each thin film heater resistor. Since the number of electrical conductors can become large when a large number of heater resistors are employed in a high density (high DPI—dots per inch) printhead, various multiplexing techniques have been introduced to reduce the number of conductors needed to connect the heater resistors to circuitry disposed in the printer. See, for example, U.S. Pat. No. 5,541,629 "Printhead with Reduced Interconnections to a Printer" and U.S. Pat. No. 5,134,425, "Ohmic Heating Matrix". Each electrical conductor, despite its good conductivity, imparts an undesirable amount of resistance in the path of the heater resistor. This undesirable parasitic resistance uselessly dissipates a portion of the electrical energy which otherwise would be available to the heater resistor thereby contributing to the heat gain of the printhead. If the heater resistance is low, the magnitude of the current drawn to nucleate the ink vapor bubble will be relatively large resulting in the amount of energy wasted in the parasitic resistance of the electrical conductors being significant relative to that provided to the heater resistor. That is, if the ratio of resistances between that of the heater resistor and the parasitic resistance of the electrical conductors (and other components) is too small, the efficiency (and the temperature) of the printhead suffers with the wasted energy.

The ability of a material to resist the flow of electricity is a property called resistivity. Resistivity is a function of the material used to make the resistor and does not depend upon the geometry of the resistor of the thickness of the resistive film used to form the resistor. Resistivity is related to resistance according to:

$$R=\rho L/A$$

where R=resistance (Ohms); ρ=resistively (Ohm-cm); L=length of resistor; and A=cross sectional area of resistor. For thin film resistors typically used in thermal inkjet printing applications, a property commonly known as sheet resistance ($R_{sheet}$) is commonly used in analysis and design of heater resistors. Sheet resistance is the resistivity divided by the thickness of the film resistor, and resistance is related to sheet resistance by:

$$R=R_{sheet}(L/W)$$

where L=length of the resistive material and W=width of the resistive material. Thus, resistance of a thin film resistor of a given material and of a fixed film thickness is a simple calculation of length and width for rectangular and square geometries.

Most of the thermal inkjet printers available today use square heater resistors that have a resistance of 35 to 40 Ω. If it were possible to use resistors with higher values of resistance, the energy needed to nucleate an ink vapor bubble would be transmitted to the thin film heater resistor at a higher voltage and lower current. The energy wasted in the parasitic resistances would be reduced and the power supply that provides the power to the heater resistors could be made smaller and less expensive.

As users of inkjet printers have begun to desire finer detail in the printed output from a printer, the technology has been pushed into a higher resolution of ink drop placement on the medium. One of the common ways of measuring the resolution is the measurement of the maximum number of ink dots deposited in a selected dimension of the printed medium, commonly expressed as dots per-inch (DPI). The production of an increased DPI requires smaller drops. Smaller ink drops means a lowered drop weight and lowered drop volume for each drop. Production of low drop weight ink drops requires smaller structures in the printhead. Smaller drops and resultant dots means that more dots must be placed on the medium at a higher rate in order to maintain a reasonable speed of printing, i.e., the number of pages printed per minute. The increased speed of printing requires a higher rate of drop generator heater resistor activation. So, designers of inkjet printheads are faced with the problem of more drop generators (with their associated heater resistors) disposed over a smaller area of printhead being operated at an increased frequency. These requirements produce a higher density of heat and higher temperatures.

One approach to resolving the heat problem has been to increase the size of the semiconductor substrate as a heat spreader and heat sink. This approach, however, leads to an unacceptably higher cost, since processed semiconductor material costs rise exponentially with increased area. Moreover, there is a strong motivation to maintain a constant sized silicon substrate to enable manufacturing of varying printhead performance levels on the same manufacturing equipment. It is possible to control printhead temperature by slowing the rate of heater resistor activation—the duty cycle of the heating pulses can be lower—but this leads to a lower page per minute printing delivery and is unacceptable to the user of the printing device. Thus, what is needed is a solution that enables compact printheads with high density drop generators and high printing throughput but without excessive heat generation within the printhead.

SUMMARY OF THE INVENTION

A high density drop generator inkjet printhead includes a semiconductor substrate with at least one surface that has a predetermined area upon which is disposed a multiplicity of heater resistors at a density of at least six heater resistors per square millimeter. A passivation layer is disposed on a portion of the at least one surface of the semiconductor substrate to a thickness having a range of between 3550 Å and 4350 Å over each of the multiplicity of heater resistors.

DETAILED DESCRIPTION OF A PREFERRED EMBODIMENT

In order to realize high drop generator density and high throughput without high printhead temperatures, control and reduction of energy input must be undertaken. To this end several unique improvements have been made to yield improved heater resistor and printhead efficiency.

There are two major sources of heat generation—the heater resistor itself and the combined resistance of the energizing power thin film conductors and the thin film ground return conductors disposed on the semiconductor substrate. Each conventional heater resistor has a resistance of approximately 40 Å including the parasitic resistance of the thin film conductors on the substrate. With a high density of heater resistors for the drop generators, there exists a high density of thin film conductors with attendant parasitic resistance. In a conventional implementation, the parasitic resistance associated with each heater resistor can reach 10 Ω, a significant fraction of the total resistance of a heater resistor connection and a significant contributor to the ohmic heating of the semiconductor substrate. A feature of the present invention is the use of higher resistance heater resistors. While there are several techniques for obtaining a higher resistance heater resistor for use in a thermal inkjet printer application, a preferred embodiment of the present invention utilizes a reconfiguration of thin film resistor geometries to yield higher resistance heater resistors.

Once the electrical energy has been coupled to the heater resistor and converted to heat energy thereby, the heat energy must be coupled to the ink in the most efficient manner. Another feature of the present invention is the improvement in the efficiency of coupling heat energy from the heater resistor to the ink.

Figure 1A:
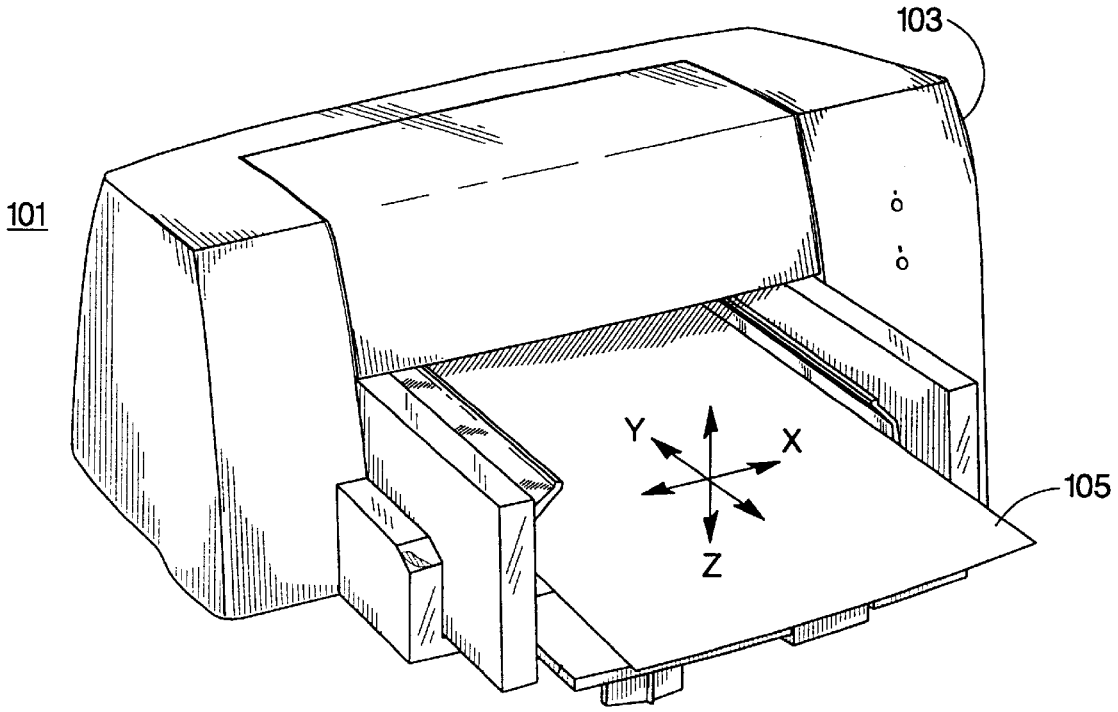
FIG. 1A is an isometric drawing of an exemplary printing apparatus which may employ the present invention.
Figure 1B:
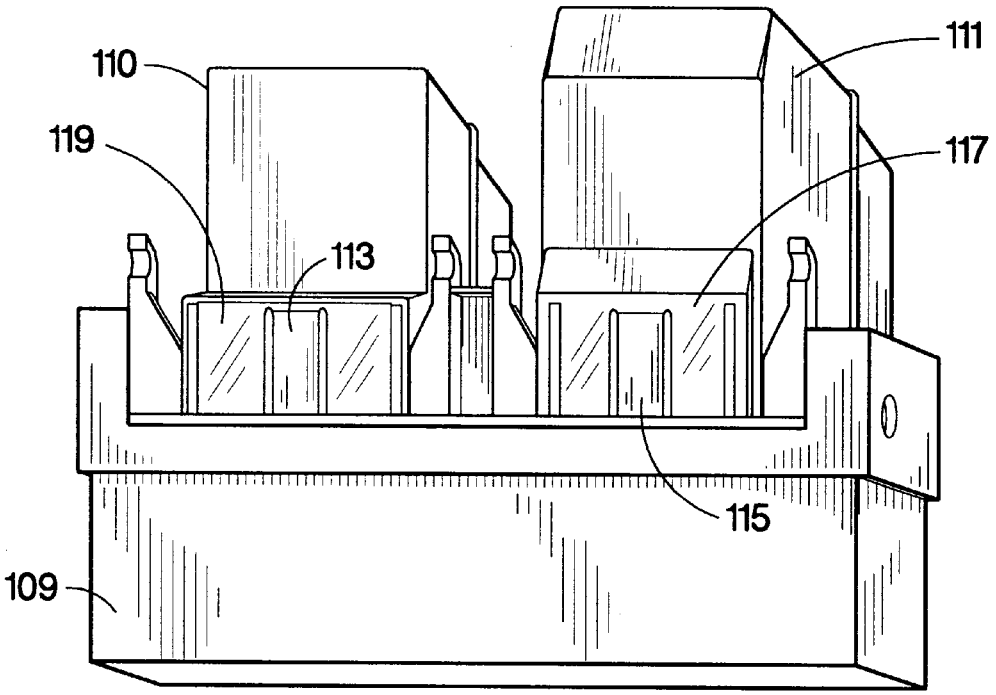
FIG. 1B is an isometric drawing of a print cartridge carriage apparatus which may be employed in the printing apparatus of FIG. 1A.

An exemplary inkjet printing apparatus, a printer 101, that may employ the present invention is shown in outline form in the isometric drawing of FIG. 1A. Printing devices such as graphics plotters, copiers, and facsimile machines may also profitably employ the present invention. A printer housing 103 contains a printing platen to which an input print medium 105, such as paper, is transported by mechanisms that are known in the art. A carriage within the printer 101 holds one or a set of individual print cartridges capable of ejecting ink drops of black or color ink. Alternative embodiments can include a semi-permanent printhead mechanism that is sporadically replenished from one or more fluidically-coupled off-axis ink reservoirs, or a single print cartridge having two or more colors of ink available within the print cartridge and ink ejecting nozzles designated for each color, or a single color print cartridge or print mechanism; the present invention is applicable to a printhead employed by at least these alternatives. A carriage 109, which may be employed in the present invention and mounts two print cartridges 110 and 111, is illustrated in FIG. 1B. The carriage 109 is typically supported by a slide bar or similar mechanism within the printer and physically propelled along the slide bar to allow the carriage 109 to be translationally reciprocated or scanned back and forth across the print medium 105. The scan axis, X, is indicated by an arrow in FIG. 1B. As the carriage 109 scans, ink drops are selectively ejected from the printheads of the set of print cartridges 110 and 111 onto the medium 105 in predetermined print swath patterns, forming images or alphanumeric characters using dot matrix manipulation. Generally, the dot matrix manipulation is determined by a user's computer (not shown) and instructions are transmitted to a microprocessor-based, electronic controller within the printer 101. Other techniques employ a rasterization of the data in a user's computer prior to the rasterized data being sent, along with printer control commands, to the printer. This operation is under control of printer driven software resident in the user's computer. The printer interprets the commands and rasterized data to determine which drop generators to fire. The ink drop trajectory axis, Z, is indicated by the arrow. When a swath of print has been completed, the medium 105 is moved an appropriate distance along the print media axis, Y, indicated by the arrow, in preparation for the printing of the next swath. This invention is also applicable to inkjet printers employing alternative means of imparting relative motion between printhead and media, such as those that have fixed printheads (such as page wide arrays) and move the media in one or more directions, those that have fixed media and move the printhead in one or more directions (such as flatbed plotters). In addition, this invention is applicable to a variety of printing systems, including large format devices, copiers, fax machines, photo printers, and the like.

The inkjet carriage 109 and print cartridges 110, 111 are shown from the —Z direction within the printer 101 in FIG. 1B. The printheads 113, 115 of each cartridge may be observed when the carriage and print cartridges are viewed from this direction. In a preferred embodiment, ink is stored in the body portion of each printhead 110,115 and routed through internal passageways to the respective printhead. In an embodiment of the present invention which is adapted for multi-color printing, three groupings of orifices, one for each color (cyan, magenta, and yellow), is arranged on the foraminous orifice plate surface of the printhead 115. Ink is selectively expelled for each color under control of commands from the printer that are communicated to the printhead 115 through electrical connections and associated conductive traces (not shown) on a flexible polymer tape 117. In the preferred embodiment, the tape 117 is typically bent around an edge of the print cartridge as shown and secured. In a similar manner, a single color ink, black, is stored in the ink-containing portion of cartridge 110 and routed to a single grouping of orifices in printhead 113. Control signals are coupled to the printhead from the printer on conductive traces disposed on a polymer tape 119.

Figure 2:
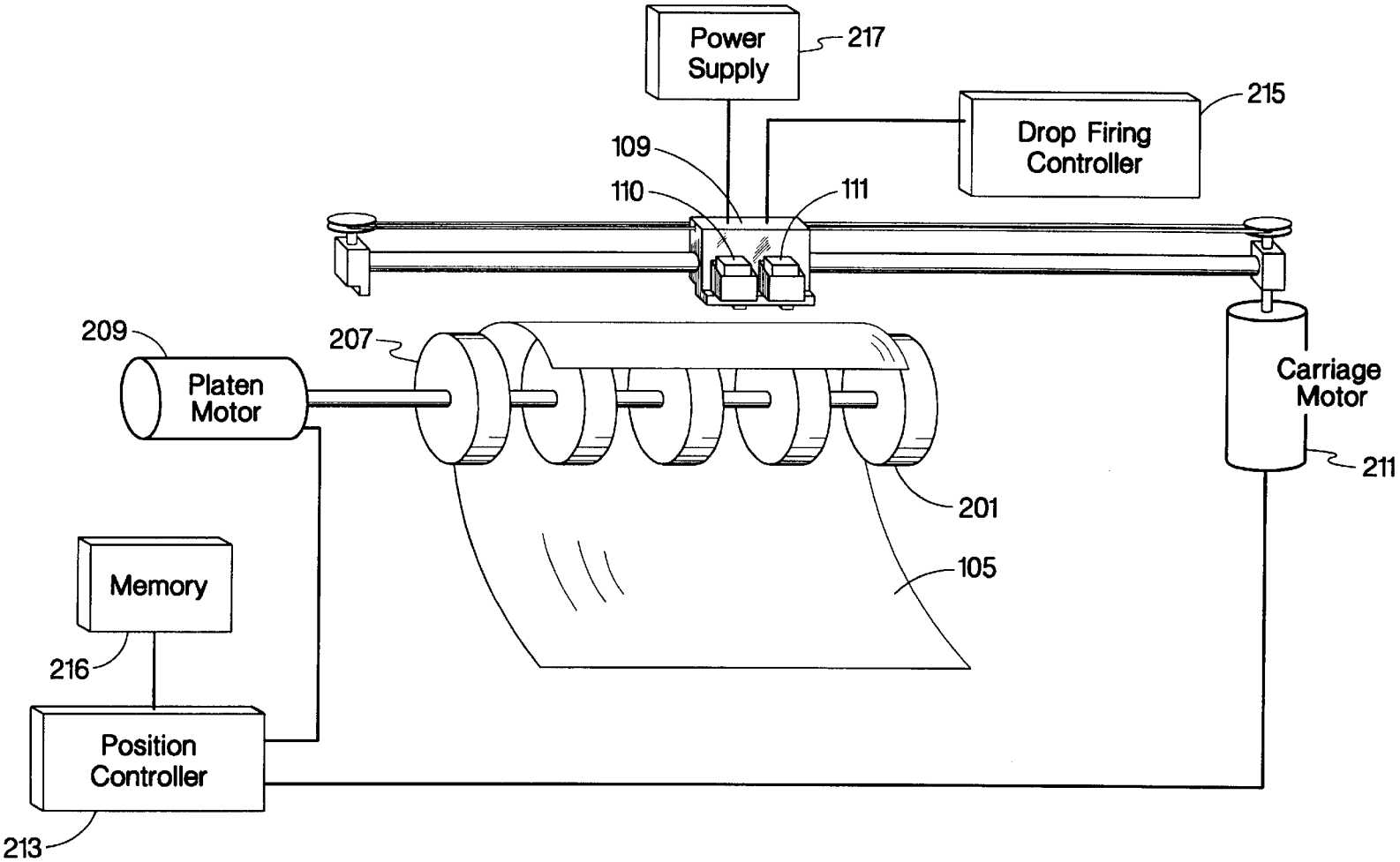
FIG. 2 is a schematic representation of the functional elements of the printer of FIG. 1A.

As can be appreciated from FIG. 2, a single medium sheet is advanced from an input tray into a printer print area beneath the printheads by a medium advancing mechanism including a roller 207, a platen motor 209, and traction devices (not shown). In a preferred embodiment, the inkjet print cartridges 110, 111 are incrementally drawn across the medium 105 on the platen by a carriage motor 211 in the ±X direction, perpendicular to the Y direction of entry of the medium. The platen motor 209 and the carriage motor 211 are typically under the control of a media and cartridge position controller 213. An example of such positioning and control apparatus may be found described in U.S. Pat. No. 5,070,410 "Apparatus and Method Using a Combined Read/Write Head for Processing and Storing Read Signals and for Providing Firing Signals to Thermally Actuated Ink Ejection Elements". Thus, the medium 105 is positioned in a location so that the print cartridges 110 and 111 may eject drops of ink to place dots on the medium as required by the data that is input to a drop firing controller 215 and power supply 217 of the printer. These dots of ink are formed from the ink drops expelled from selected orifices in the printhead in a band parallel to the scan direction as the print cartridges 110 and 111 are translated across the medium by the carriage motor 211. When the print cartridges 110 and 111 reach the end of their travel at an end of a print swath on the medium 105, the medium is conventionally incrementally advanced by the position controller 213 and the platen motor 209. Once the print cartridges have reached the end of their traverse in the X direction on the slide bar, they are either returned back along the support mechanism while continuing to print or returned without printing. The medium may be advanced by an incremental amount equivalent to the width of the ink ejecting portion of the printhead or some fraction thereof related to the spacing between the nozzles. Control of the medium, positioning of the print cartridge, and selection of the correct ink ejectors for creation of an ink image or character is determined by the position controller 213. The controller may be implemented in a conventional electronic hardware configuration and provided operating instructions from conventional memory 216. Once printing of the medium is complete, the medium is ejected into an output tray of the printer for user removal.

Figure 3:
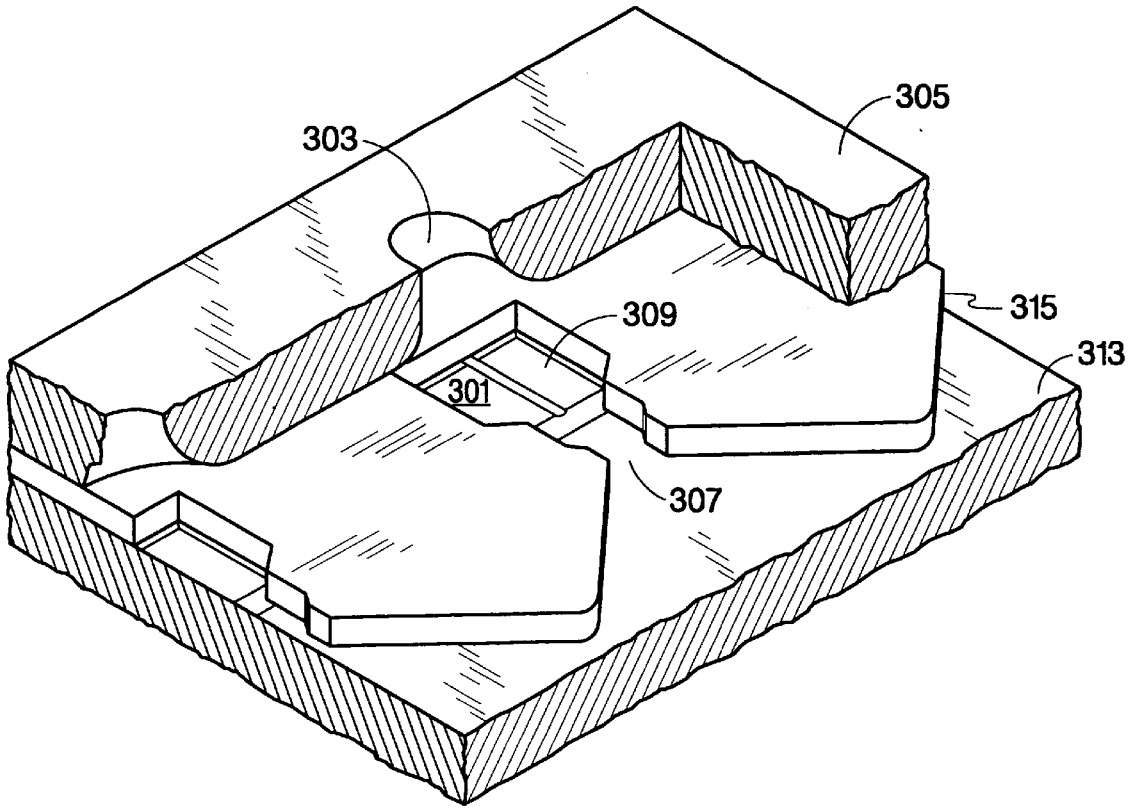
FIG. 3 is a magnified isometric cross section of a drop generator which may be employed in the printhead of the print cartridge of FIG. 1A.

A single example of an ink drop generator found within a printhead is illustrated in the magnified isometric cross section of FIG. 3. As depicted, the drop generator comprises a nozzle, a firing chamber, and an ink ejector. Alternative embodiments of a drop generator employ more than one coordinated nozzle, firing chamber, and/or ink ejectors. The drop generator is fluidically coupled to a source of ink.

In FIG. 3, the preferred embodiment of an ink firing chamber 301 is shown in correspondence with a nozzle 303 and a segmented heater resistor 309. Many independent nozzles are typically arranged in a predetermined pattern on the orifice plate 305 so that the ink drops are expelled in a controlled pattern. Generally, the medium is maintained in a position which is parallel to the plane of the external surface of the orifice plate. The heater resistors are selected for activation in a process that involves the data input from an external computer or other data source coupled to the printer in association with the drop firing controller 215 and power supply 217. Ink is supplied to the firing chamber 301 via opening 307 to replenish ink that has been expelled from orifice 303 following the creation of an ink vapor bubble by heat energy released from the segmented heater resistor 309. The ink firing chamber 301 is bounded by walls created by: the orifice plate 305, a layered semiconductor substrate 313, and barrier layer 315. In a preferred embodiment, fluid ink stored in a reservoir of the cartridge housing flows by capillary force to fill the firing chamber 301.

Figure 4:
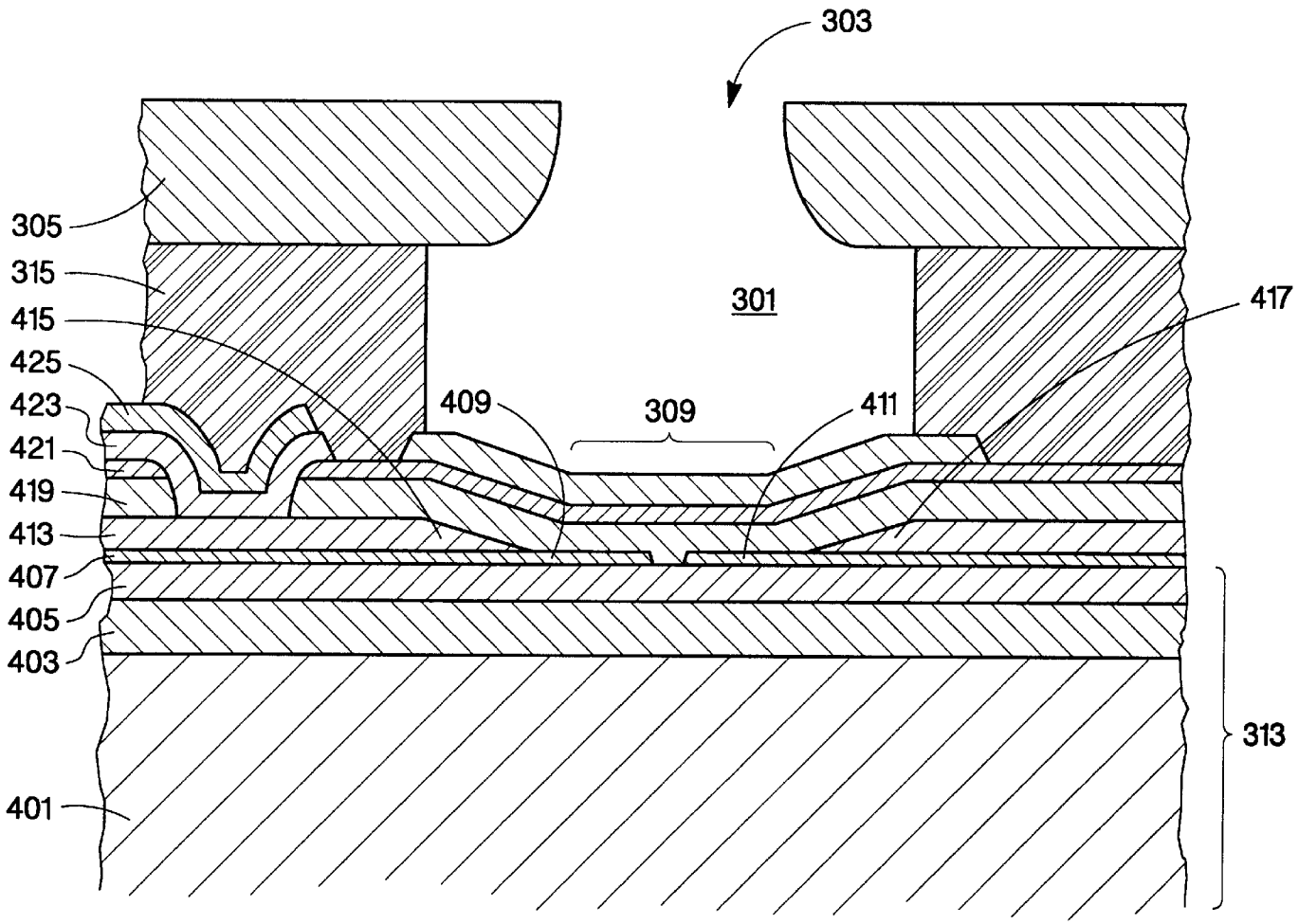
FIG. 4 is a cross sectional elevation view of the drop generator of FIG. 3 illustrating the layers of material that form a drop generator useful in the present invention.

In FIG. 4, a cross section of the firing chamber 301 and the associated structures are shown. The substrate 313 comprises, in the preferred embodiment, a semiconductor base 401 of silicon, treated using either thermal oxidation or vapor deposition techniques to form a thin layer 403 of silicon dioxide and a thin layer 405 of phospho-silicate glass (PSG) thereon. The silicon dioxide and PSG forms an electrically insulating layer approximately 17000 Å thick upon which a subsequent layer 407 of tantalum-aluminum (TaAl) resistive material is deposited. The tantalum-aluminum layer is deposited to a thickness of approximately 900 Å to yield resistivity in the range of 27.1 Ω per square to 31.5 Ω per square and preferably at a value of 29.3 Ω per square. In a preferred embodiment, the resistive layer is conventionally deposited using a magnetron sputtering technique and then masked and etched to create discontinuous and electrically independent areas of resistive material such as areas 409 and 411. Next, a layer 413 of aluminum-silicon-copper (Al-Si-Cu) alloy conductor is conventionally magnetron sputter deposited to a thickness of approximately 5000 Å atop the tantalum aluminum layer areas 409, 411 and etched to provide discontinuous and independent electrical conductors (such as conductors 415 and 417) and interconnect areas. To provide protection for the heater resistors and the connecting conductors, a composite layer of material is deposited over the upper surface of the conductor layer and resistor layer. A dual layer of passivating materials includes a first layer 419 of silicon nitride ($Si_3N_4$) in a range of 2350 Å to 2800 Å thick which is covered by a second layer 421 of inert silicon carbide (SiC) in a range of 1000 Å to 1550 thick. This extraordinary thin passivation layer (419, 421) provides both good adherence to the underlying materials and good protection against ink corrosion. It also provides electrical insulation. Of significance to the present invention, the passivation layer is reduced in thickness to increase heat flow from the heater resistor to the ink in chamber 301 as opposed to having a significant heat flow into the substrate. An area over the heater resistor 309 and its associated electrical connection is subsequently masked and a cavitation layer 423 of tantalum in a range of 2500 Å to 3500 Å thick is conventionally sputter deposited. A gold layer 425 may be selectively added to the cavitation layer in areas where electrical interconnection to the flexible conductive tape 119 (or 117) is desired. An example of semiconductor processing for thermal inkjet applications may be found in U.S. Pat. No. 4,862,197, "Process for Manufacturing Thermal Inkjet Printhead and Integrated Circuit (IC) Structures Produced Thereby." An alternative thermal inkjet semiconductor process may be found in U.S. Pat. No. 5,883,650, Thin-Film Printhead Device for an Ink-Jet Printer."

In a preferred embodiment, the sides of the firing chamber 301 and the ink feed channel are defined by a polymer barrier layer 315. This barrier layer is preferably made of an organic polymer plastic that is substantially inert to the corrosive action of ink and is applied using conventional techniques upon substrate 313 and its various protective layers. To realize a structure useful for printhead applications, the barrier layer is subsequently photolithographically defined into desired shapes and then etched. In the preferred embodiment, the barrier layer 315 has a thickness of about 15 μafter the printhead is assembled with the orifice plate 305.

The orifice plate 305 is secured to the substrate 313 by the barrier layer 315. In some print cartridges the orifice plate 305 is constructed of nickel with plating of gold to resist the corrosive effects of the ink. In other print cartridges, the orifice plate is formed of a polyamide material that can be used as a common electrical interconnect structure. In an alternative embodiment, the orifice plate and barrier layer is integrally formed on the substrate.

Figure 5:
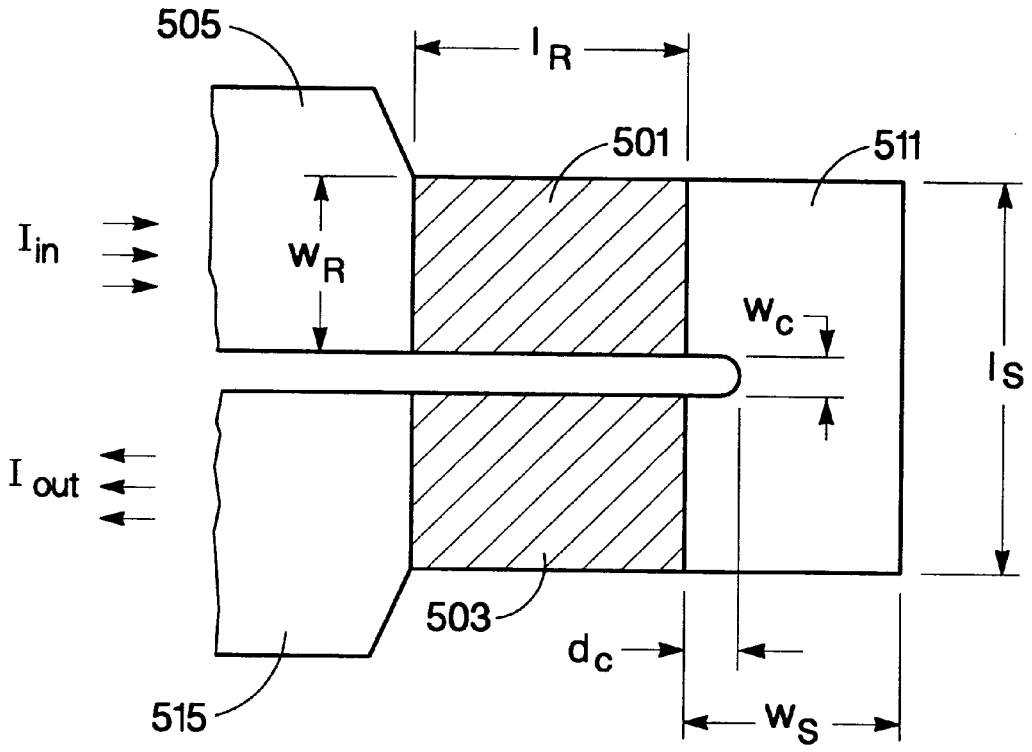
FIG. 5 is a plan view of a segmented heater employing a shorting bar useful in a printhead employing the present invention.

In a preferred embodiment of the present invention, a heater resistor having a higher value of resistance is employed to overcome some of the excess heat deposition problem stated above, in particular the problem of undesired energy dissipation in the parasitic resistance. The implementation of a higher value resistance heater resistor is that of revising the geometry of the heater resistor, specifically that of providing two segments having a greater length than width. Since it is preferred to have the heater resistor 309 located in one compact spot for optimum vapor bubble nucleation in a top-shooting (ink drop ejection perpendicular to the plane of the heater resistor) printhead, the resistor segments are disposed long side to long side as illustrated in FIG. 5. As shown, heater resistor segment 501 is disposed with one of its long sides essentially parallel to the long side of heater resistor segment 503. Electrical current $I_{in}$ is input via conductor 505 to the resistor segment 501 disposed at one of the short sides (width) edges of resistor segment 501. The electrical current, in the preferred embodiment, is coupled to the input of the resistor segment 503 disposed at one of the short side (width) edges of resistor segment 503 by a coupling device that has been termed a "shorting bar" 511. The shorting bar is a portion of conductor film disposed between the output of heater resistor segment 501 and the input of heater resistor segment 503. The electrical current lout is returned to the power supply via conductor 515 connected to the output of heater resistor segment 503. As shown, with no additional electrical current sources or sinks, $I_{in}=I_{out}$. The outputs of heater resistor segments 501 and 503, respectively, are disposed at the opposite short side (width) edges of the heater resistor segments from the input ports.

Figure 8:
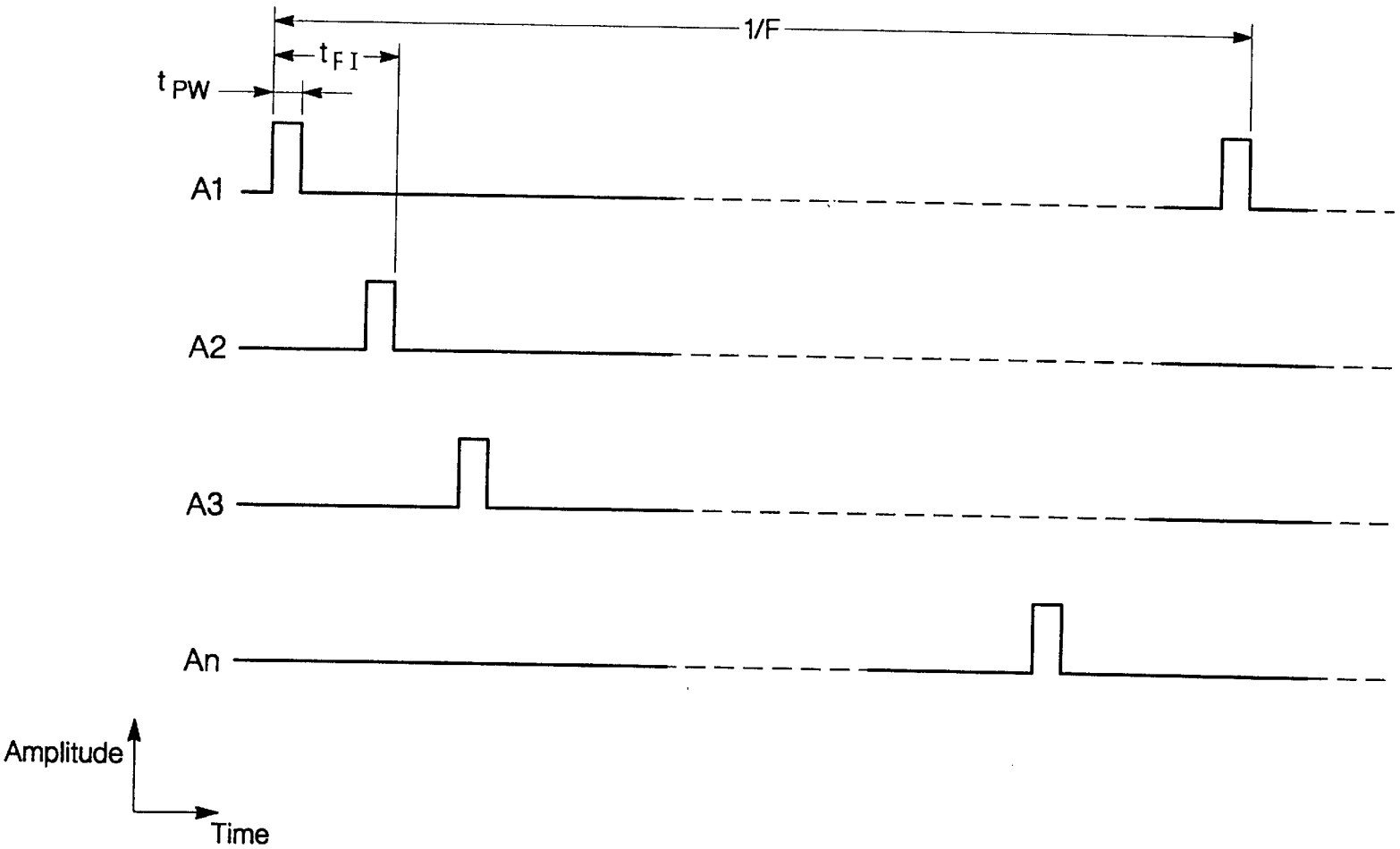
FIG. 8 is a timing diagram of heater resistor activation which may be employed in the present invention.

In the preferred embodiment, where the resistance of each segmented heater resistor ink ejector is nominally 140 Ω and the electrical power supply voltage is 10.8 Volts ±1%, the plan view design dimensions of the heater resistors of FIG. 8 include a heater resistor segment length, $I_R$, of ranging between 20.5 μm and 24.0 μm and width, $w_R$, ranging between 9.0 μm and 11.0 μm. The shorting bar includes a length, $I_S$, of approximately 20.5 μm and a width, $w_S$, of approximately 20 μm. The design center value for the shorting bar cut is for a notch of depth, $d_C$, ranging between 2.2 μm and 4.2 μm and a notch width, $w_C$, ranging between 1.5 μm and 5.0 μm. The cut shape for the preferred embodiment was determined to be a rounded, or "U"-shaped, notch to avoid sharp discontinuities that would increase current crowding at points of small radius. Nevertheless, other cut shapes can be employed at the designer's choice, to obtain other performance advantages.

Figure 6:
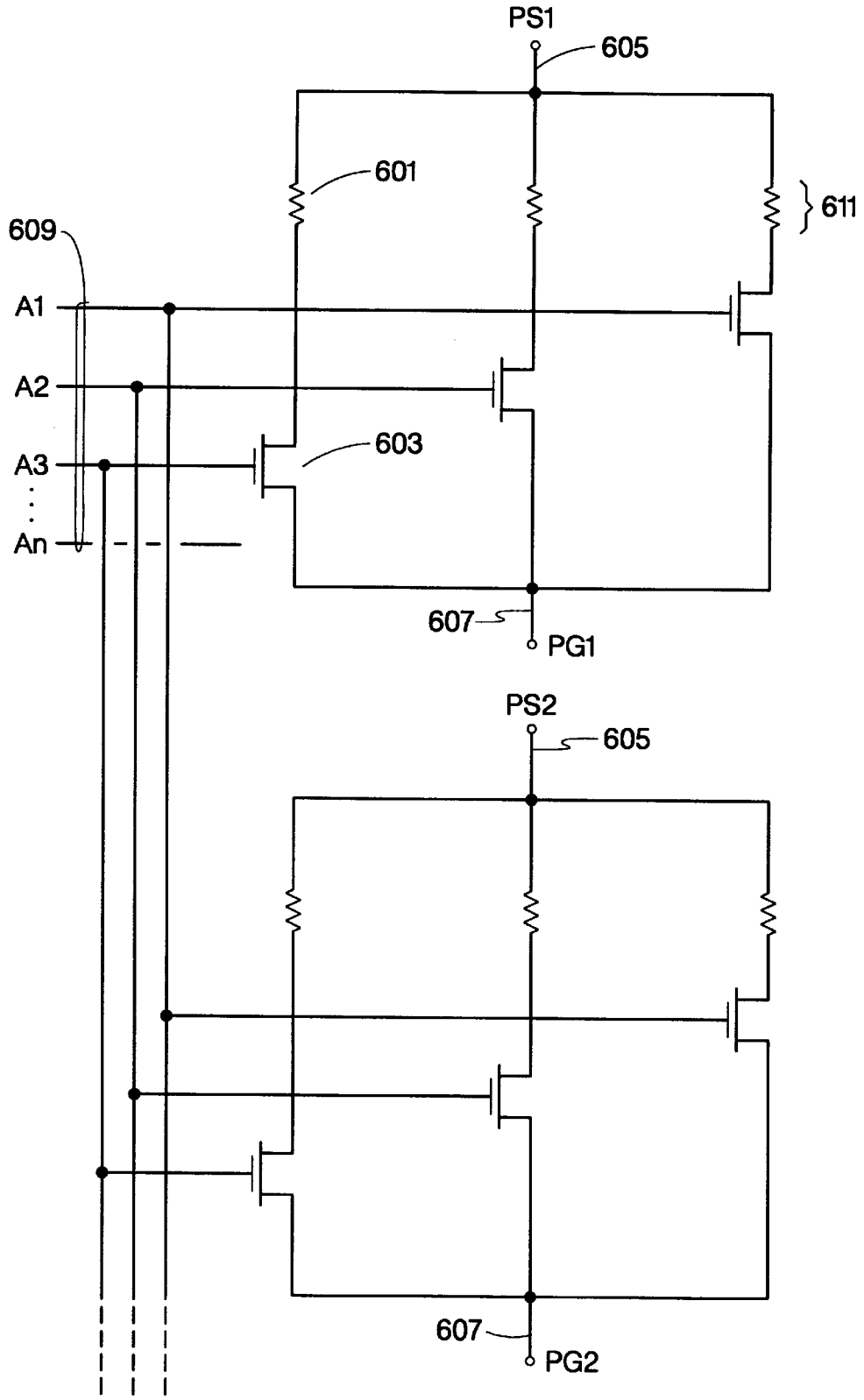
FIG. 6 is an electrical schematic of a heater resistor addressing arrangement that may be employed in the present invention.

FIG. 6 is an electrical schematic that illustrates a drop generator integrated drive head matrix circuitry which is to be found on the printhead of a preferred embodiment. This configuration enables the selection of which drop generator to fire in response to print commands from the drop firing controller 215 and power supply 217. Each ink ejecting heater resistor is arranged in correspondence with a nozzle in the orifice plate and each is identified in the electrical matrix by enable signals within a print command directed to the printhead by the printer. Each drop generator generally includes the heater resistor (for example, resistor 601) and associated firing chamber and orifice plate. The heater resistor is coupled to electrical power by a switching device (for example, transistor 603). Common electrical connections include a primitive select (PS(n)) lead 605, a primitive common (PG(n)) lead 607, and address interconnections A1, A2, and A3 (as many as $A_n$) 609. Each switching device (e.g. 603) is connected in series with each heater resistor (e.g. 601) between the primitive select 605 and primitive common 607 leads. The address interconnections 609 (e.g. address A3) are connected to the control port of the switch device (e.g. 603) for switching the device between a conductive state and a nonconductive state. In the conductive state, the switch device 603 completes a circuit from the primitive select lead 605 through the heater resistor 601 to the primitive common lead 609 to energize the heater resistor when primitive select PS1 is coupled to a source of electrical power.

Each row of drop generator heater resistors in the matrix is deemed a primitive and may be selectively prepared for firing by powering the associated primitive select lead 605, for example PS1 for the row of heater resistors designated 611 in FIG. 6. While only three heater resistors are shown here, it should be understood that any number of heater resistors can be included in a primitive, consistent with the objectives of the designer and the limitations imposed by other printer and printhead constraints. Likewise, the number of primitives is a design choice of the designer. To provide uniform energy for the heater resistors of the primitive, it is preferred that only one series switch device per primitive be energized at a time. However, any number of the primitive selects may be enabled concurrently. Each enabled primitive select, such as PS1 or PS2, thus delivers both power and one of the enable signals to the heater resistor. One other enable signal for the matrix is an address signal provided by each control interconnection 609, such as A1, A2, etc., only one of which is preferably active at a time. Each address interconnection 609 is coupled to all of the switch devices in a matrix column so that all such switch devices in the column are conductive when the interconnection is enabled or "active," i. e. at a voltage level which turns on the switch devices. Where a primitive select and an address interconnection for a heater resistor are both active concurrently, that resistor is electrically energized, rapidly heats, and vaporizes ink in the associated ink firing chamber.

Figure 7A:
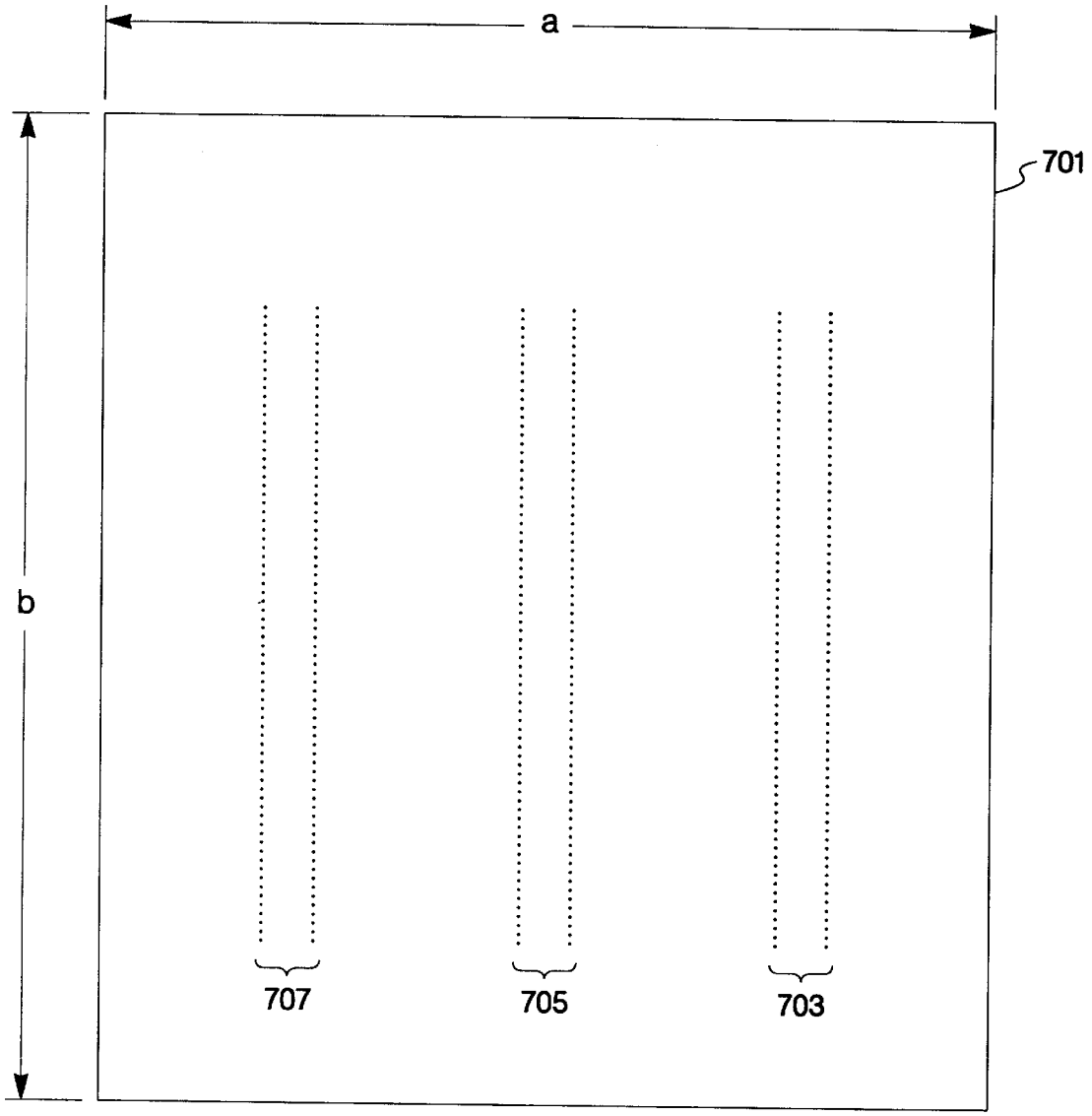
FIG. 7A is a plan view of a printhead orifice plate which may be employed by the printhead of the print cartridge of FIG. 1A.
Figure 7B:
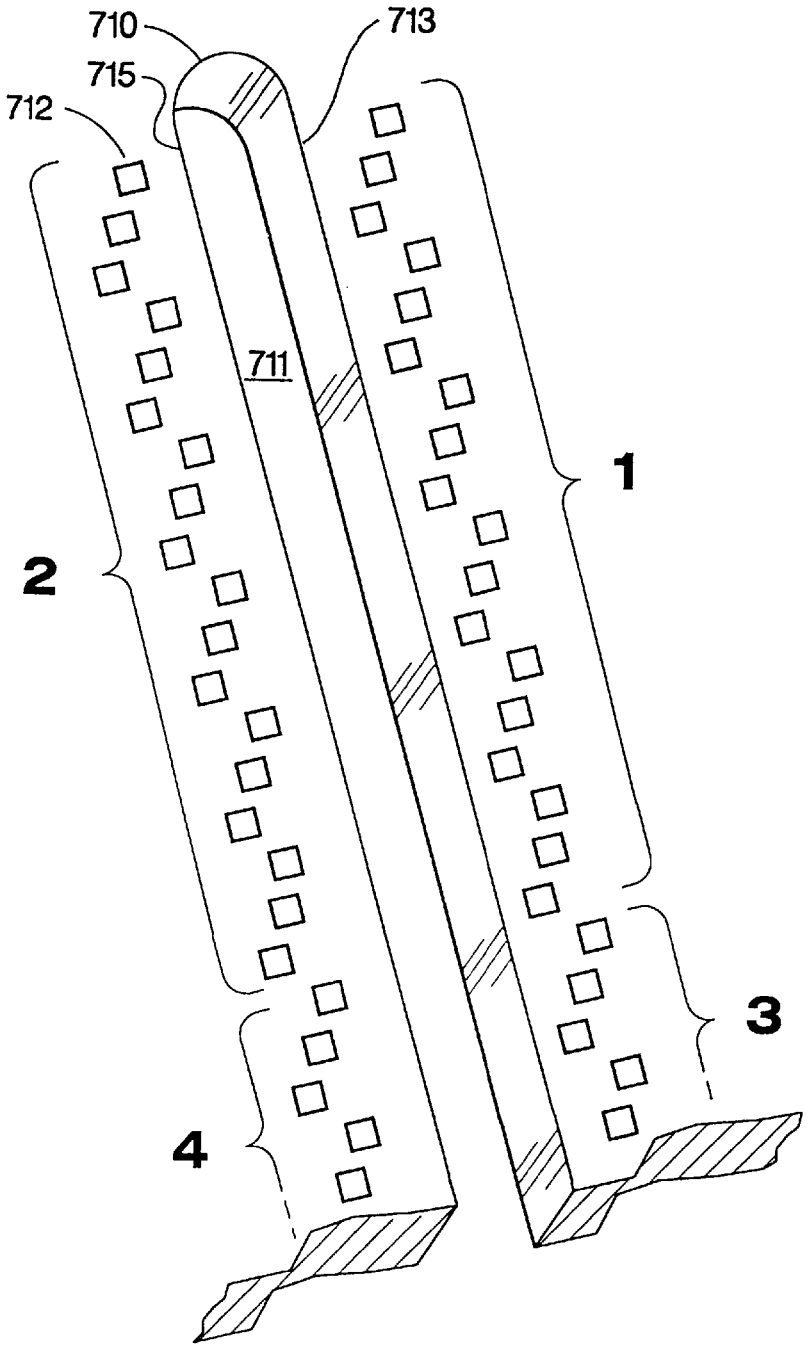
FIG. 7B is a plan view of a printhead substrate which may be employed by the printhead of the print cartridge of FIG. 1A.

In a preferred embodiment, a total of 432 drop generators are arranged on a printhead n three color groups of 144 drop generators each. The arrangement is such that 1200 DPI resolution in the scan direction, X, is achieved. FIG. 7A illustrates the outer surface 701 of the orifice plate of a printhead which may employ the present invention. The dimensions of the semiconductor substrate to which the orifice plate is secured are shown as a width dimension, a, of nominally 7.9 mm (along the X, scan, direction) and a height dimension, b, of nominally 8.7 mm which is held within a 0.4% tolerance. The drop generator nozzles are shown in essentially parallel rows of 144 nozzles each: a yellow group 703, a cyan group 705, and a magenta group 707. Within each color group, the heater resistors are organized into eight primitives. Considering one of the color groups, for example the yellow group, a magnified view of a portion of the heater resistor of this group with the orifice plate and firing chamber-defining barrier layer removed is illustrated in FIG. 7B. In a preferred embodiment, the heater resistors (for example, heater resistor 712) are arranged on both long sides of an elongated ink supply slot 711. This ink supply slot extends from the top surface to the substrate, which includes the heater resistors, to the bottom surface, through which ink is source from the rest of the print cartridge. Four primitives are shown disposed at one linear edge 713 of the elongated ink supply slot 711 example primitives numbered 1, 3, 5, and 7, and electrically coupled as shown in FIG. 6. Four other primitives, numbered 2, 4, 6, and 8, are disposed at the other linear edge 715 of the elongated ink feed slot opening 711.

The Address Select lines are sequentially turned on via the electrical conductors of the flexible tape 117 or 1 19 according to the drop firing controller 215 located in the printer which sequences (independently of the data directing which resistor is to be energized) from A1 to $A_n$ when printing form left to fight and from $A_n$ to A1 when printing from right to left. The print data retrieved from the memory within the drop firing controller 215 turns on any combination of the Primitive Select lines.

The firing signals applied to the address lines A1–$A_n$ are shown in the timing diagram of FIG. 8. The amplitude of the address line signals is shown on the y axis and time is shown on the x axis. During one firing cycle (1/F) every address in each primitive is fired; thus, every heater resistor in every primitive can be energized once during a firing cycle. Each firing cycle is made up of a plurality of firing intervals ($t_{FI}$). The firing interval for a printhead in the preferred embodiment comprises several of the firing intervals for each heater resistor and consists of a pulse time ($t_{PW}$) plus a dead time. This pulse time is the amount of time that the energy exceeding the turn-on energy is applied to the selected heater resistor. In the preferred embodiment this pulse time is 1.4 $\mu$sec ±0.1 $\mu$msec. The remainder of time, the dead time, is the time interval from the end of one pulse on an Address line (for example, A1) and the beginning of the next sequential pulse on the next Address line (A2). The dead time length not only provides time for the print cartridge carriage 109 to move to the next firing position (if required) but, as a feature of the present invention, provides a cooling period during which no energy is applied to the printhead. Furthermore, each heater resistor is not always selected for printing; the selection occurs as a function of the character or image to be printed and is selected by the appropriate address and primitive lines being selected with regard to the particular position of the print cartridge relative to the medium. Thus, the power supply 217 is not always supplying power to the printhead.

In a preferred embodiment, an address line is turned on first then a primitive select line is turned on for the desired pulse time. In order that the print cartridge employing the present invention be able to rapidly deposit ink dots on the medium (particularly for small drops in the 8 ng weight range), the heater resistors must be energized at a high rate. Depending upon the mode of operation of the printing device using the print cartridge employing the present invention, the firing rate can be set in excess of 18 KHz (for a draft printing mode). Nominally, the firing rate is set at 15 KHz. When power is supplied to a selected heater resistor, it is limited by the value of the resistance of the heater resistor, the power supply voltage, and the pulse time duration. In a preferred embodiment, a firing pulse is in the range of 1.0 to 1.4 μJoules. In order to realize sufficient energy in the approximately 1.4 μsec pulse to exceed turn-on energy, the thickness of the passivation layer was reduced as described above. Such a thin silicon-based passivation layer had been subject to defeats in the past but improved processing and beveling of the conductor layer 413 has enabled the thinner passivation layer to be used.

Accordingly, a printhead employing a segmented heater resistor arrangement to obtain a higher heater resistance, a thinner passivation layer, and a lower heater resistor activation energy enables a-compact printhead with high density drop generators and high printing throughput without excessive heat generation within the printhead to be realized.

We claim:

1. A high density drop generator inkjet printhead realizing at least 1200 dpi in at least one direction of printing comprising:

a semiconductor substrate with at least one surface, said surface having a predetermined area;

a multiplicity of heater resistors disposed on said at least one surface at a density of at least six heater resistors per square millimeter and each heater resistor adapted to eject an ink drop when an energy pulse between 1.0 and 1.4 μjoules is applied; and a passivation layer disposed on a portion of said at least one surface of said semiconductor substrate to a thickness having a range of between 3350 Å and 4350 Å over each of said multiplicity of heater resistors thereby avoiding damaging printhead temperatures.

2. A high density drop generator inkjet printhead in accordance with claim 1 wherein said passivation layer further comprises a first sublayer comprising silicon nitride disposed over each of said multiplicity of heater resistors to a range of thickness of between 2350 Å and 2800 Å and a second sublayer comprising silicon carbide disposed coextensively with said first sublayer to a range of thickness of between 1000 Å and 1550 Å.

3. A high density drop generator inkjet printhead in accordance with claim 1 further comprising a cavitation layer disposed on at least a portion of said passivation layer to a range of thickness of between 2500 Å and 3500 Å.

4. A high density drop generator inkjet printhead in accordance with claim 1 wherein each heater resistor of said multiplicity of heater resistors further comprises two series coupled resistive segments.

5. A high density drop generator inkjet printhead in accordance with claim 4 wherein each heater resistor of said multiplicity of heater resistors further comprises a resistive planar sheet having a resistivity range of between 27.1 Ω/square and 31.5 Ω/square at least one of said two series coupled resistive segments comprises a range of length dimensions between 20.5 μm and 24.0 μm, and said at least one of said two series coupled resistive segments comprises a range of width dimensions between 9.0 μm and 11.0 μm.

6. An inkjet print cartridge comprising said high density drop generator inkjet printhead in accordance with claim 1.

7. A thermal inkjet printing apparatus providing at least a 1200 dpi deposition of ink dots in at least one direction of printing on a medium comprising:

a processor that selects a predetermined number of drop generators to place ink dots on the medium;

a power supply that provides a pulse of electrical energy to said predetermined number of drop generators;

a print cartridge comprising a supply of ink and a multiplicity of drop generators in a printhead from which said predetermined number of drop generators is selected, said printhead further comprising:

a semiconductor substrate with at least one surface, said surface having a predetermined area;

a multiplicity of heater resistors disposed on said at least one surface at a density of at least six heater resistors per square millimeter, corresponding to said multiplicity of drop generators and each heater resistor adapted to eject an ink drop when an energy pulse between 1.0 and 1.4 μJoules is applied; and a passivation layer disposed on a portion of said at least one surface of said semiconductor substrate to a thickness having a range of between 3350 Å and 4350 Å over each of said multiplicity of heater resistors thereby avoiding damaging printhead temperatures.

8. A thermal inkjet printing apparatus in accordance with claim 7 wherein said power supply further comprises a pulse generator whereby a pulse of electrical energy is applied to each said selected predetermined number of drop generators, said pulse lasting a duration of between 1.31 μsec and 1.5 μsec.

9. A thermal inkjet printing apparatus in accordance with claim 7 wherein said passivation layer further comprises a first sublayer comprising silicon nitride disposed over each of said multiplicity of heater resistors to a range of thickness of between 2350 Å and 2800 Å and a second sublayer comprising silicon carbide disposed coextensively with said first sublayer to a range of thickness of between 1000 Å and 1550 Å.

10. A thermal inkjet printing apparatus in accordance with claim 7 further comprising a cavitation layer disposed on at least a portion of said passivation layer to a range of thickness of between 2500 Å and 3500 Å.

11. A thermal inkjet printing apparatus in accordance with claim 7 wherein each heater resistor of said multiplicity of heater resistors further comprises two series coupled resistive segments.

12. A thermal inkjet printing apparatus in accordance with claim 11 wherein each heater resistor of said multiplicity of heater resistors further comprises a resistive planar sheet having a resistivity range of between 27.1 Ω/square and 31.5 Ω/square, at least one of said two series coupled resistive segments comprises a range of length dimensions between 20.5 μm and 24.0 μm, and said at least one of said two series coupled resistive segments comprises a range of width dimensions between 9.0 μm and 11.0 μm.

13. A thermal inkjet printing apparatus in accordance with claim 7 wherein said processor and said power supply comprise a drop generator energy source that selectively delivers energy in an amount in a range of 1.0 μJoules to 1.4 μJoules for ejection of an ink drop from at least one of said multiplicity of heater resistors.

14. A method of operation of a thermal inkjet printing apparatus that includes a processor to select a predetermined number of drop generators to place ink dots on a medium, a power supply to supply power to the predetermined number of drop generators, and a substrate supporting a predetermined number of heater resistors associated with the predetermined number of drop generators, comprising the step of:

supplying voltage within a range of 10.7 Volts to 10.9 Volts for a pulse time within the range of 1.3 μsec to 1.5 μsec to the substrate for a heater resistor of the predetermined number of heater resistors to eject a drop of ink.

15. A high density drop generator inkjet printhead comprising:

a semiconductor substrate with at least one surface, said surface having a predetermined area upon which is disposed a multiplicity of heater resistors at a density of at least six heater resistors per square millimeter, each heater resistor of said multiplicity of heater resistors further comprising two series coupled resistive segments and each heater resistor of said multiplicity of heater resistors further comprising a resistive planar sheet having a resistivity range of between 27.1 Ω/square and 31.5 Ω/square at least one of said two series coupled resistive segments comprising a range of length dimensions between 20.5 μm and 24.0 μm, and said at least one of said two series coupled resistive segments comprising a range of width dimensions between 9.0 μm and 11.0 μm; and a passivation layer disposed on a portion of said at least one surface of said semiconductor substrate to a thickness having a range of between 3350 Å and 4350 Å over each of said multiplicity of heater resistors.

16. A thermal inkjet printing apparatus providing a high density deposition of ink dots on a medium comprising:

a processor that selects a predetermined number of drop generators to place ink dots on the medium;

a power supply that provides a pulse of electrical energy to said predetermined number of drop generators;

a print cartridge comprising a supply of ink and a multiplicity of drop generators in a printhead from which said predetermined number of drop generators is selected, said printhead further comprising:

a semiconductor substrate with at least one surface, said surface having a predetermined area upon which is disposed a multiplicity of heater resistors at a density of at least six heater resistors per square millimeter and corresponding to said multiplicity of drop generators, each heater resistor of said multiplicity of heater resistors further comprising two series coupled resistive segments and each heater resistor of said multiplicity of heater resistors further comprising a resistive planar sheet having a resistivity range of between 27.1 Ω/square and 31.5 Ω/square, at least one of said two series coupled resistive segments comprising a range of length dimensions between 20.5 μm and 24.0 μm, and said at least one of said two series coupled resistive segments comprising a range of width dimensions between 9.0 μm and 11.0 μm; and a passivation layer disposed on a portion of said at least one surface of said semiconductor substrate to a thickness having a range of between 3350 Å and 4350 Å over each of said multiplicity of heater resistors.

* * * * *